US005560056A

United States Patent [19]

Tai

[11] Patent Number: 5,560,056

[45] Date of Patent: Oct. 1, 1996

[54] MULTIPLE-PURPOSE HAMMOCK, CHAIR, AND FLOAT TYPE APPARATUS

[76] Inventor: Tsai-Ting Tai, c/o Hung Hsing Patent Service Center, P.O. Box 55-1670, Taipei, Taiwan

[21] Appl. No.: 379,143

[22] Filed: Jan. 27, 1995

[51] Int. Cl.[6] ..... A45F 3/22; A47C 13/00

[52] U.S. Cl. ..... 5/120; 5/413 AM; 5/722; 297/118; 297/4; 297/452.41; 441/129

[58] Field of Search ..... 5/120, 122, 465, 5/455, 449, 420, 413; 297/118, 380, 452.41; 441/129

[56] References Cited

U.S. PATENT DOCUMENTS

| | | | |
|---|---|---|---|
| 2,284,900 | 6/1942 | Henderson et al. | 5/122 |
| 2,623,574 | 12/1952 | Damsch | 297/118 |
| 4,518,203 | 5/1985 | White | 5/465 |
| 5,384,923 | 1/1995 | Hwang et al. | 297/380 |
| 5,474,361 | 12/1995 | Hwang et al. | 297/452.41 |

FOREIGN PATENT DOCUMENTS

| | | | |
|---|---|---|---|
| 1004666 | 4/1952 | France | 297/452.41 |

*Primary Examiner*—Alexander Grosz

[57] ABSTRACT

An outdoor living apparatus includes: a shell having a mattress bag portion and a sleeping bag portion superimposed with each other; an inflatable mattress which may be normally embedded in the mattress bag portion of the shell to serve as a bed mattress adapted to be slept by a user sleeping in the sleeping bag portion superimposed on the mattress bag portion when the shell and the mattress are flattened, or may be removed from the mattress bag portion of the shell to serve as a swimming or beach mattress or as a life buoy in case of ship accidents; and a pair of convertible setting belts normally fastened to two opposite end portions of the shell to suspend the shell and the inflatable mattress filled in the shell between two fixtures or trees to be a hammock, or the two setting belts converted to be fastened to a right and a left side of a chair as folded from the hammock with flattened shell and mattress for seating purpose.

4 Claims, 4 Drawing Sheets

MULTIPLE-PURPOSE HAMMOCK, CHAIR, AND FLOAT TYPE APPARATUS

BACKGROUND OF THE INVENTION

U.S. Pat. No. 2,284,900 to O. D. Henderson et al. disclosed an outdoor sleeper comprising an elongated casing or envelope formed from duck or other suitable materials and embodying a bottom, side walls, end walls and a top wall to accommodate a person and forms the body of the hammock as suspended by ropes. However, the sleeper of Henderson et al. can not be folded to be a sofa chair or can not be provided for other multiple uses, thereby limiting its commercial value.

The present inventor has found the drawbacks of the conventional sleeper or hammock, and invented the present outdoor living apparatus for multiple purposes.

SUMMARY OF THE INVENTION

The object of the present invention is to provide an outdoor living apparatus including: a shell having a mattress bag portion and a sleeping bag portion superimposed with each other; an inflatable mattress which may be normally embedded in the mattress bag portion of the shell to serve as a bed mattress adapted to be slept on by a user sleeping in the sleeping bag portion superimposed on the mattress bag portion when the shell and the mattress are flattened, or may be removed from the mattress bag portion of the shell to serve as a swimming or beach mattress or as a life buoy in case of ship accidents; and a pair of convertible setting belts normally fastened to two opposite end portions of the shell to suspend the shell and the inflatable mattress positioned in the shell between two fixtures or trees to be a hammock, or the two setting belts converted to be fastened to a right and a left side of a chair as folded from the hammock with flattened shell and mattress for seating purpose.

DETAILED DESCRIPTION

Figure 1:
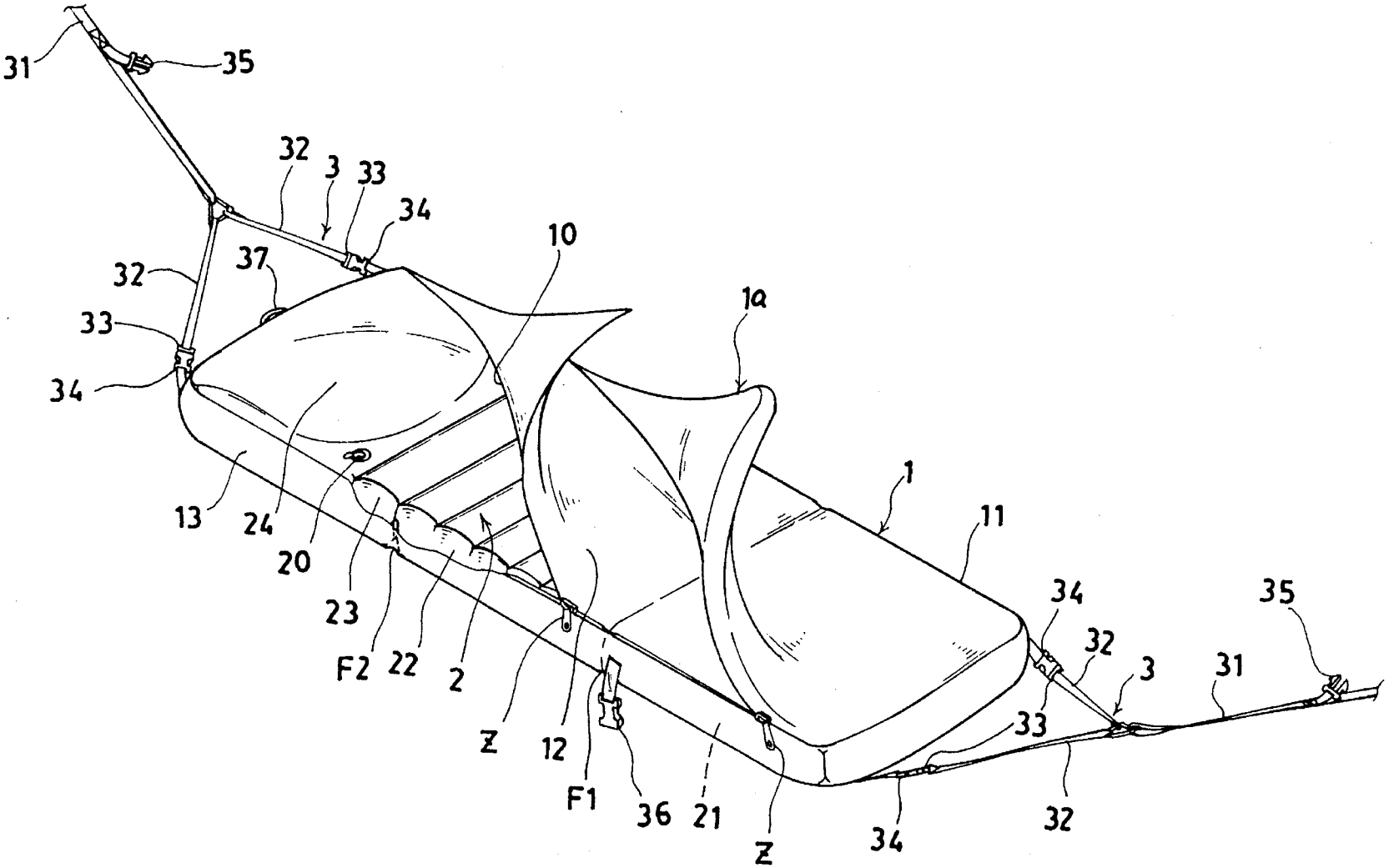
FIG. 1 is a partial cut-away illustration of the present invention.

As shown in the drawing figures, the present invention comprises: a shell 1 made of cloth, canvas, leather, plastic or other suitable materials; an inflatable mattress 2 positioned, lined or embedded in the shell 1 and made of elastomers such as rubber or other inflatable, thermally insulative material; and a pair of convertible setting belts 3 respectively secured to two opposite end or side portions of the shell 1 for suspending the shell 1 embedded with the mattress for sleeping purpose, or for firmly fastening a folded structure of the shell and the mattress as folded from a flattened shell 1 and mattress 2 for serving as a sofa chair. The belts 3 may be made of flexible leather, plastic materials (such as Nylon) and other suitable materials having good strength. The inflatable mattress 2 may be filled with thermally insulative lining fillers in the mattress 2, but it is so conventional and is therefore not described in detail hereinafter.

The shell 1 includes: a mattress bag portion 10 for positioning the inflatable mattress 2 in the mattress bag portion 10; a sleeping bag portion 1*a* superimposed on the mattress bag portion 10 for embodying a user in the sleeping bag portion 1*a* for sleeping purpose; a first shell section 11 adjacent to a foot side F of the shell 1 having a first convertible setting belt 3 securable to a foot-side edge portion 15 formed on an end portion of the first shell section 11; a second shell section 12 connected to the first shell section 11 along a first folding line F1 transversely formed across the shell 1; a third shell section 13 adjacent to a head side H of the shell and connected to the second shell section 12 along a second folding line F2 transversely formed across the shell 1 having a second convertible setting belt 3 securable to a head-side edge portion 16 formed on an end portion of the third shell section 13; and a pillow portion 14 integrally formed and protruding upwardly or outwardly from the third shell section 13 for cushioning a user's head portion.

Each bag portion 10 or 1*a* may be opened or closed on the shell 1 by a zipper Z, which is a conventional art and will not be described in detail herewith.

Figure 6:
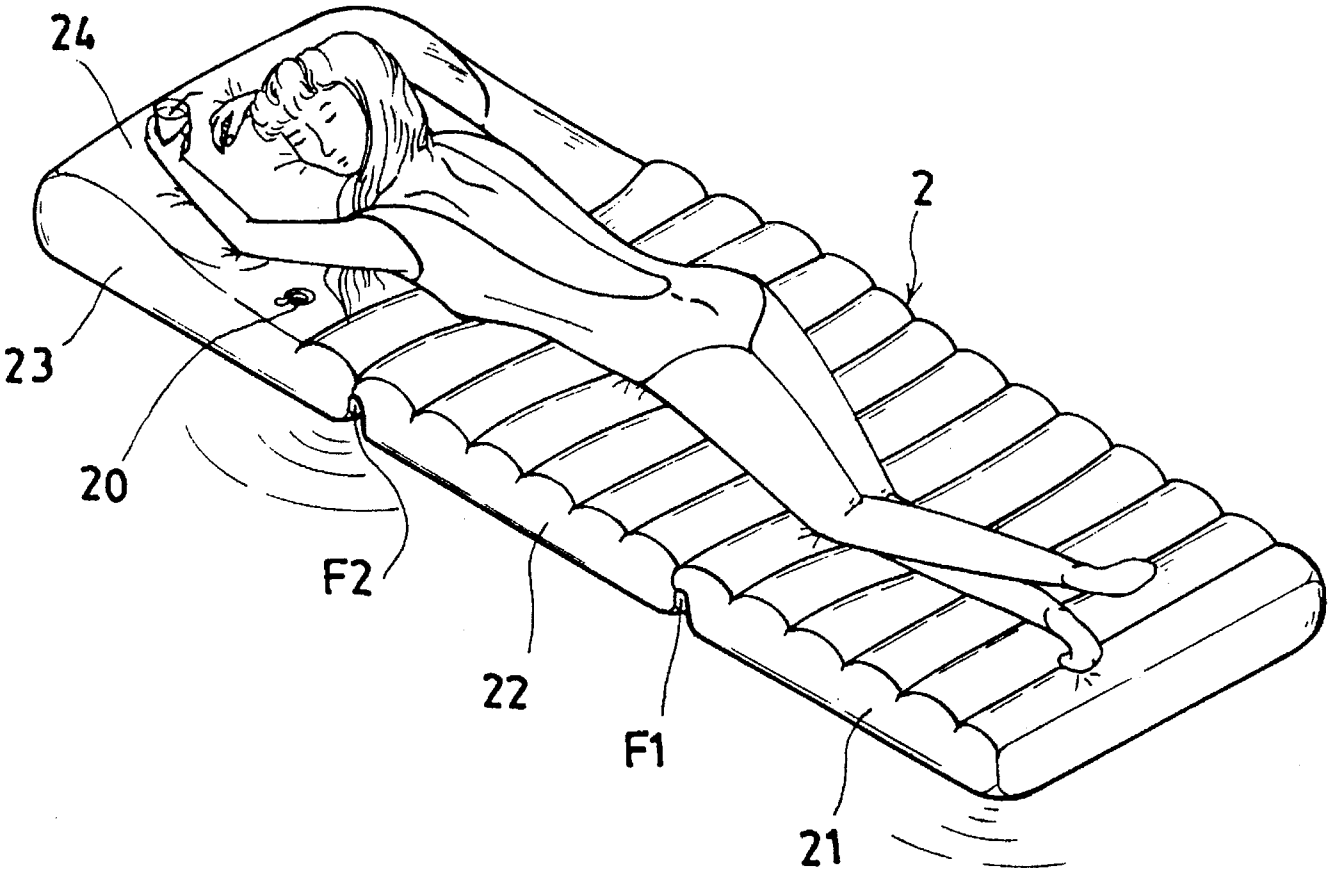
FIG. 6 is an illustration when withdrawing the inflatable mattress from the shell of the present invention to serve as a swimming mattress.

The inflatable mattress 2 includes: an inflating valve 20 for filling air or compressed air in the mattress to expansively form a cushioning pad or floatable buoy, a first mattress section 21 corresponding to the first shell section 11 of the shell 1, a second mattress section 22 corresponding to the second shell section 12 and connected to the first mattress section 21 along a first mattress folding line f1 projectively coinciding with the first folding line F1 of the shell 1, a third mattress section 23 corresponding to the third shell section 13 and connected to the second mattress section 22 along a second mattress folding line F2 projectively coinciding with the second folding line F2 of the shell 1, and a pillow mattress portion 24 formed on the third mattress section 23 to match with the pillow portion 14 of the shell 1; whereby upon a removal of the inflatable mattress 2 from the shell 1 and a flattening of the mattress 2, the mattress 2 may serve as a swimming or beach mattress as shown in FIG. 6, or serve as a life buoy for rescuing purpose in a ship accident.

Figure 2:
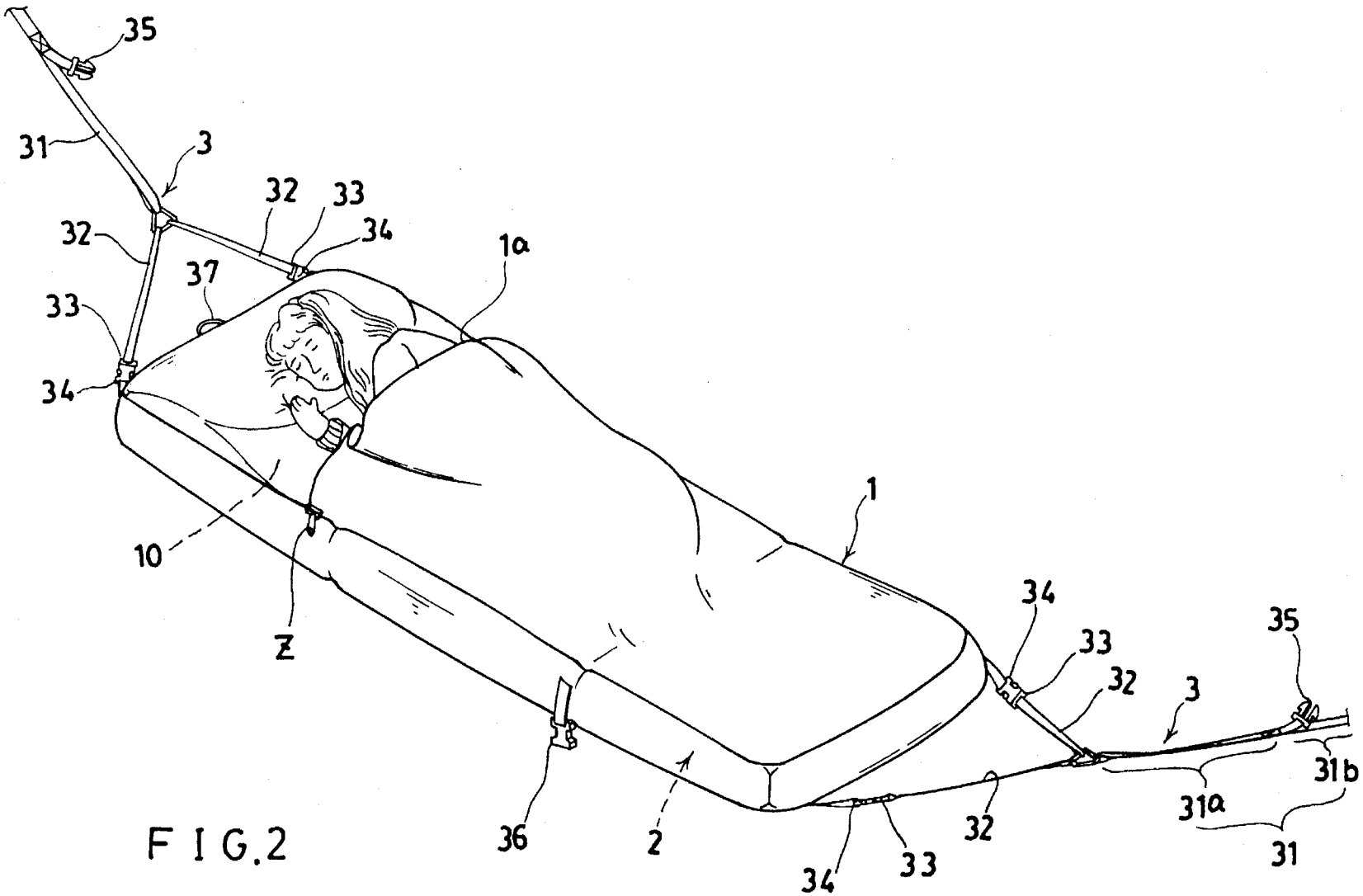
FIG. 2 is a perspective view of the present invention serving as a sleeping bag or hammock.
Figure 3:
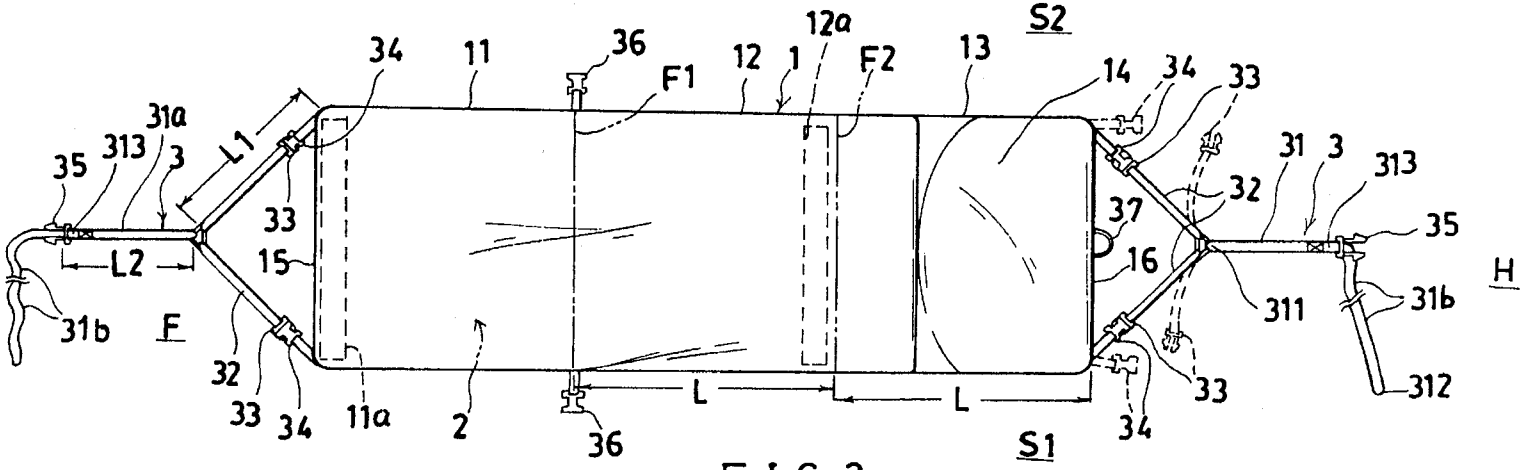
FIG. 3 is a top view of the present invention as flattened for sleeping purpose.

Each convertible setting belt 3 includes: a main strip 31, a pair of side strips 32 bifurcated from the main strip 31 with each side strip 32 having a male connector 33 formed on an end portion of each side strip 32 to be engageable with a female connector 34 secured to each corner portion of the head-side edge portion 16 or foot-side edge portion 15 for forming generally Y shaped for securing the two side strips 32 to two opposite corner portions each corner portion defined between the head side H and the left side S1 (or right side S2) of the shell 1 or defined between the foot side F and the left side S1 (or right side S2) of the shell when flattening the shell 1 and the inflatable mattress 2 positioned in the shell 1 to be a hammock or sleeper for sleeping purpose as shown in FIGS. 2 and 3.

The mattress 2 may be formed with a plurality of corrugations transversely across the mattress 2.

Figure 5:
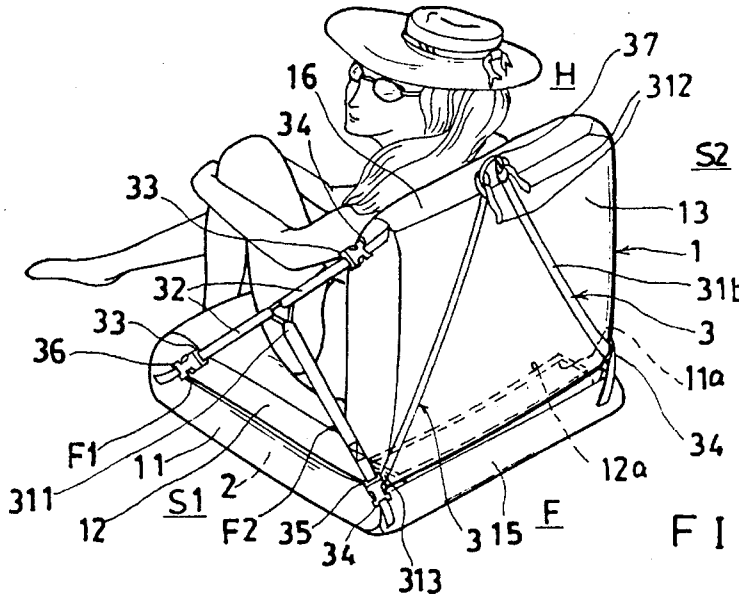
FIG. 5 is a perspective view of FIG. 4.
Figure 4:
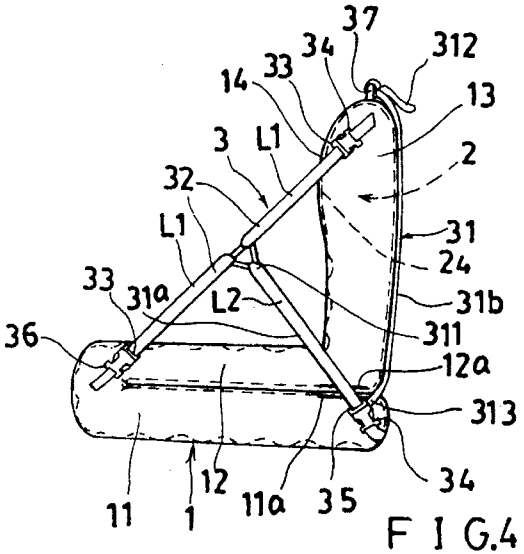
FIG. 4 is a side view of the present invention when folded from FIG. 3 to serve as a sofa chair.

Each main strip 31 of the convertible setting belt 3 includes: a proximal strip section 31*a* located between a fixed end portion 311 of the main strip 31 at a connecting point between each side strip 32 and the main strip 31, and an intermediate portion 313 located between the fixed end portion 311 and a tail end portion 312 securable to a fixture, frame or tree for suspending the setting belt 3 and the shell 1 for serving as a hammock; and a distal strip section 31*b* located between the intermediate portion 313 and the tail end portion 312; a female connector 36 formed on a left or right side S1 or S2 at the first folding line F1 between the first and the second shell sections 11, 12 of the shell 1; a male connector 35 formed on the intermediate portion 313 of the main strip 31 to be connectable with a female connector 34 formed on a corner portion located between a foot-side edge portion 15 and a left or right side portion S1 or S2 of the shell when folding the first shell section 11 of the shell 1 to be superimposed under the second shell section 12 to be a seat and vertically erecting the third shell section 13 on the second shell section 12 to be a back, thereby forming a sofa chair as shown in FIGS. 4 and 5, having the two male connectors 33 of the two side strips 32 of each setting belt 3 respectively connectable to a female connector 34 formed on a corner portion located between the head-side edge portion 16 and the left side portion S1 or right side portion S2 of the shell 1, and connectable to each female connector 36 formed on the left or right side portion S1, S2 of the first folding line F1; whereby upon fastening of the two side strips 32 of each belt 3 on the side portion S1 or S2 of the shell 1 between the head-side edge portion 16 of the third shell section 13 and the first folding line F1 of the second and first shell sections 12, 11; and upon fastening of the male connector 35 at the intermediate portion 313 of each setting belt 3 with the female connector 34 at a side portion S1 or S2 of the foot-side edge portion 15 of the first shell section 11, the proximal strip section 31*a* of each belt 3 will be tensioned between each female connector 34 formed at the foot-side edge portion 15 of the first shell section 11 and perpendicularly connected to a generally linear arrangement of the two side strips 32 as tensioned between a female connector 34 formed on a side of the head-side edge portion 16 and another female connector 36 formed at a side portion of the folding line F1 to be generally T shaped; and upon a fastening of the distal strip section 31*b* from the intermediate portion 313 through a back portion of the third shell section 13 to allow the tail end portion 312 to be tied on a bracket 37 (which may be a collar) fixed on the head-side edge portion 16 of the third shell section 13, a sofa chair can be firmly set up.

Two Velcro tapes 11*a*, 12*a* are respectively formed on each bottom portion of the first and second shell sections 11, 12, whereby upon a superimposed folding of the two shell sections 11, 12 as shown in FIG. 4 by engaging the two Velcro tapes 11*a*, 12*a* with each other, the two shell sections 11, 12 will be folded more stably.

As shown in FIGS. 3–5, if the third section 13, the second section 12 and the two strips 32 form a right-angle triangle as shown in FIG. 4 and if the length of each shell section 13, 12, 11 is generally equal and designated as L, each side strip 32 has a length of L1, and the proximal strip section 31*a* has a length of L2, the following formulas will be obtained:

$$1.\ (L1 + L1)^2 = L^2 + L^2$$
$$L1^2 = L^2/2$$
$$L1 = L/\sqrt{2} = 0.707L$$
$$2.\ L2 \geqq L1$$

L2 may be equal or slightly larger than L1.

The present invention may be modified without departing from the spirit and scope as claimed in the claims. The shapes, materials and styles in construction or this invention are not limited.

The present invention provides a living of life apparatus having multiple uses, such as sleeper, hammock, sofa chair, swimming mattress, life buoy, etc., with rich commercial value, but with simple construction and low cost.

I claim:

1. An outdoor living apparatus comprising:

a foldable shell (1);

a foldable inflatable mattress (2) positioned in said shell (1); and a pair of convertible setting belts (3) respectively connectable to two opposite end portions of said shell (1);

said shell (1) including: a mattress bag portion (10) for positioning the inflatable mattress (2) in the mattress bag portion (10); a sleeping bag portion (1*a*) superimposed on the mattress bag portion (10) for embodying a user in the sleeping bag portion (1*a*) for sleeping purpose; a first shell section (11) adjacent to a foot side (F) of the shell (1) having a first convertible setting belt (3) securable to a foot-side edge portion (15) formed on an end portion of the first shell section (11); a second shell section (12) connected to the first shell section (11) along a first folding line (F1) transversely formed across the shell (1); a third shell section (13) adjacent to a head side (H) of the shell and connected to the second shell section (12) along a second folding line (F2) transversely formed across the shell (1) having a second convertible setting belt (3) securable to a head-side edge portion (16) formed on an end portion of the third shell section (13); and a pillow portion (14) integrally formed and protruding upwardly from the third shell section (13) for cushioning a user's head portion;

said inflatable mattress (2) including: an inflating valve (20) for filling air in the mattress to expansively form a cushioning pad and floatable buoy, a first mattress section (21) corresponding to the first shell section (11) of the shell (1), a second mattress section (22) corresponding to the second shell section (12) and connected to the first mattress section (21) along a first mattress folding line (F1) projectively coinciding with the first folding line (F1) of the shell (1), a third mattress section (23) corresponding to the third shell section (13) and connected to the second mattress section (22) along a second mattress folding line (F2) projectively coinciding with the second folding line (F2) of the shell (1), and a pillow mattress portion (24) formed on the third mattress section (23) to match with the pillow portion (14) of the shell (1); and each said convertible setting belt (3) including: a main strip (31), a pair of side strips (32) bifurcated from the main strip (31) with each said side strip (32) having a male connector (33) formed on an end portion of each said side strip (32) to be engageable with a female connector (34) secured to a corner portion formed on each side portion of the head-side edge portion (16) or the foot-side edge portion (15) for forming generally Y shape for securing the two side strips (32) to two opposite corner portions on each end portion of said shell (1) when flattening the shell (1) and the inflatable mattress (2) positioned in the shell (1) to be a hammock for sleeping purpose.

2. An outdoor living apparatus according to claim 1, wherein each said main strip (31) of the convertible setting belt (3) includes: a proximal strip section (31*a*) having a fixed end portion (311) of the main strip (31) located at a connecting point between each said side strip (32) and the main strip (31), an intermediate portion (313) intermediate between the fixed end portion (311) and a tail end portion (312) securable to a fixture frame for suspending the setting belt (3) and the shell (1) for serving as a hammock; and a distal strip section (31*b*) from the intermediate portion (313) to the tail end portion (312); a female connector (36) formed on a side portion (S1, S2) at the first folding line (F1) between the first and the second shell sections (11, 12) of the shell (1); a male connector (35) formed on the intermediate portion (313) of the main strip (31) to be connectable with a female connector (34) formed at a corner portion between a foot-side edge portion (15) and a side portion (S1, S2) of the shell when folding the first shell section (11) of the shell (1) to be superimposed under the second shell section (12) to be a seat and vertically erecting the third shell section (13) on the second shell section (12) to be a back, thereby forming a sofa chair having the two male connectors (33) of the two side strips (32) of each said setting belt (3) respectively connectable to a female connector (34) formed on a side portion of the head-side edge portion (16) of the shell (1), and connectable to each female connector (36) formed on a side portion (S1, S2) of the first folding line (F1); and said proximal strip section (31*a*) perpendicularly fastened to said two side strips (32) as linearly tensioned and fastened to a female connector (34) formed on a side portion of the foot-side edge portion (15) by engaging the male connector (35) at the intermediate portion (313) with the female connector (34) at the foot-side edge portion (15); and said distal strip section (31*b*) operatively fastened to a bracket (37) formed on said head-side edge portion (16) when erecting said third shell section (13) on said second shell section (12).

3. An outdoor living apparatus according to claim 2, wherein each said first and said second shell section is coated with a Velcro tape (11*a*, 12*a*) on each bottom portion of each said first and second shell section (11, 12), whereby upon a superimposed folding of the two shell sections (11, 12) by engaging the two Velcro tapes (11*a*, 12*a*) with each other, the two shell sections (11, 12) will be folded stably.

4. An outdoor living apparatus according to claim 2, wherein said two strips (32), said third shell section (13), and said second shell section (12) form a right-angle triangle when folded to be a chair and each said shell section (12, 13) having an equal length of L, each said side strip (32) having a length of L1, and the proximal strip section (31*a*) having a length of L2, each said length having the relationship of:

$$L1=0.707L, \text{ and } L2>L1.$$

* * * * *